United States Patent [19]

Wilson et al.

[11] 4,299,431

[45] Nov. 10, 1981

[54] UNDERWATER-MATEABLE ELECTRICAL CONNECTOR

[75] Inventors: Jeffrey V. Wilson; Leroy W. Tucker, both of Camarillo, Calif.

[73] Assignee: The United States of America as represented by the Secretary of the Navy, Washington, D.C.

[21] Appl. No.: 126,772

[22] Filed: Mar. 3, 1980

[51] Int. Cl.[3] ..... H01R 13/52

[52] U.S. Cl. ..... 339/60 R; 339/117 R

[58] Field of Search ..... 339/60, 61, 94, 117 R

[56] References Cited

U.S. PATENT DOCUMENTS

| | | | |
|---|---|---|---|
| 3,234,500 | 2/1966 | Buckland | 339/94 M |
| 3,277,424 | 10/1966 | Nelson | 339/117 R |
| 3,453,587 | 7/1969 | Neidecker | 339/256 |
| 3,546,657 | 12/1970 | Cook | 339/60 M |
| 4,074,926 | 2/1978 | Broad | 339/60 R |

*Primary Examiner*—Joseph H. McGlynn

*Attorney, Agent, or Firm*—Richard S. Sciascia; Joseph M. St.Amand; William C. Daubenspeck

[57] ABSTRACT

In an underwater-mateable connector system of the vented pin-and-socket type, the socket electrical contact system is composed of a contact ring cooperating with a contact band, the contact band being integrally provided with a multiplicity of resiliently deformable louvers. The pin electrical contact is composed of a rigid conductor disposed intermediate electrically insulating material and is arranged to provide electrical contact with the deformable louvers of the contact band. Electrically insulating interference seals are formed on either side of the contact area when mated due to differential diameters between the pin and socket. The preferred embodiment utilizes a Multilam® band (U.S. Pat. No. 3,453,587) as the contact band.

10 Claims, 7 Drawing Figures

UNDERWATER-MATEABLE ELECTRICAL CONNECTOR

BACKGROUND OF THE INVENTION

This invention relates in general to electrical connectors and in particular to fluid-proof electrical connectors suitable for mating or unmating underwater.

U.S. Pat. No. 3,277,424 is illustrative of a vented pin-and-socket connector system of a type widely used to provide underwater-mateable connections. The major drawback to this system is that the mating forces are very high and the production quality control is very difficult to achieve. Both of these problems relate directly to the design of the electrical contact area. The split-ring contact system was incorporated into the original design to allow the contact to be wiped off by the leading insulation surface. Unfortunately this type of contact must have very tight fit in order to provide the needed high local pressure after mating to ensure electrical contact and low resistance. This produces high insertion force. The fact that the insulating surfaces and the contact surface are all of the same diameter compounds this problem because there is literally an interference fit throughout the entire length of the mating travel. The contact area is further complicated by the fact that molding rubber around this shape in a production scenario always leaves rubber flashing extruded through the contact. This flashing is very difficult to remove from within the small cavity in which the contact is located and in operation the flashing will often stretch across the contact, providing reduced or broken contact quality and even higher mating forces. The fact that the contact is a split-ring also makes the connector pressure sensitive. Even though the contact pin itself is pressure balanced through the vent, the bulk modulus of the solid metal male pin is sufficiently higher than the split female ring that pressure is free to compress the socket diameter and make it nearly impossible for a diver to mate the connectors at the extended operating depths of todays diving scenarios. A connector mated at the surface and then submerged is vulnerable to the same effects and can become nearly impossible to unmate. The rubber-to-rubber seals tend to compress together and have much lower coeffients of friction, so the insulating seals themselves are not the problem. Present designs with the split-ring also frequently cause damage to the leading edge of the male pin insulation so that it rapidly wears out and no longer provides a proper wiping function.

SUMMARY OF THE INVENTION

It is therefore an object of the present invention to provide an improved underwater-mateable connector system which overcomes the disadvantages of the prior connector systems.

More specifically, it is an object of the present invention to provide an underwater-mateable connector system suitable for mating and unmating at extended ocean depths.

Another object of the present invention is to provide an underwater-mateable connector system which reduces the forces required for mating and unmating.

Another object of the present invention is to provide an underwater-mateable connector system in which the total force required for mating and unmating is reduced.

A further object of the present invention is to provide an underwater-mateable connector system in which the length of travel through which the mating and unmating force must be applied is reduced.

Another object of the present invention is to provide an underwater-mateable connector system which is simpler to manufacture and easier to maintain than the prior connector systems.

These and other objects are accomplished by providing a vented pin and socket connector system incorporating an electrical contact band as the contact in the female connector. The preferred embodiment utilizes Multilam® contact bands as described in U.S. Pat. No. 3,453,587. The female connector is a molded elastomer body with an electrical contact ring and a Multilam® contact band disposed in an intermediate portion of the socket with a vent to the external environment provided in the rear of the socket. The contact band and the socket have a common axis with diameters arranged to provide a proper electrical contact after mating with the male pin connector as well as an electrically insulating seal on both sides of the contact. The seals interference fit utilizing differential diameters between the socket and pin to wipe the water from the surfaces and provide a dielectric between the contact and external seawater or other conductors.

These and other advantages and features of the invention will become apparent from the following detailed description when considered in conjunction with the accompanying drawing wherein like reference characters refer to like or similar parts in the various embodiments.

Figure 3:
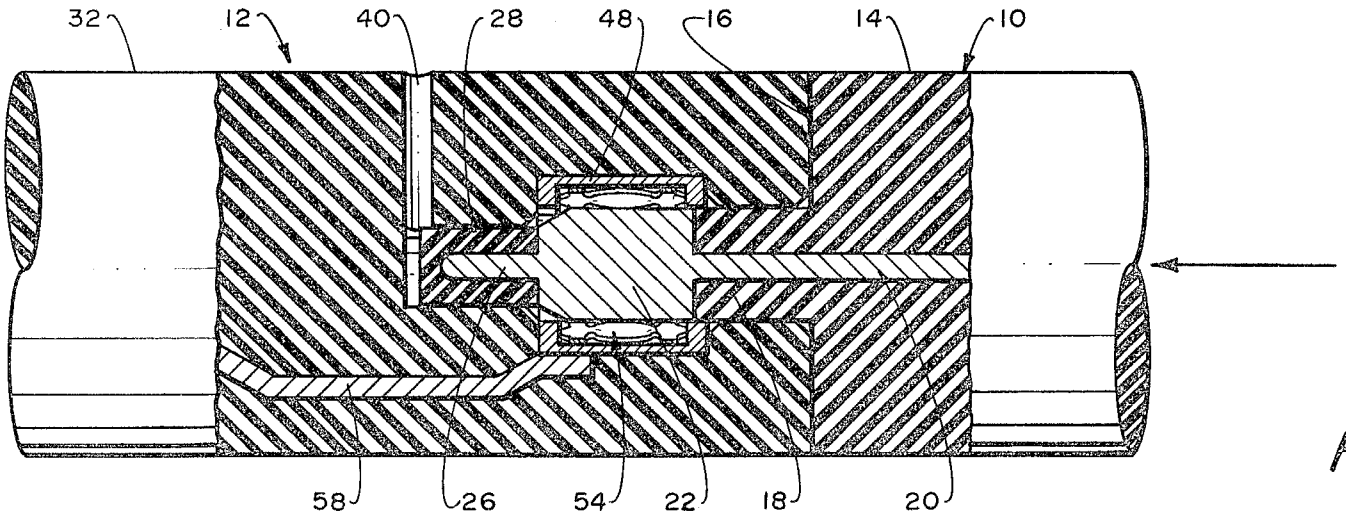
Figure 4:
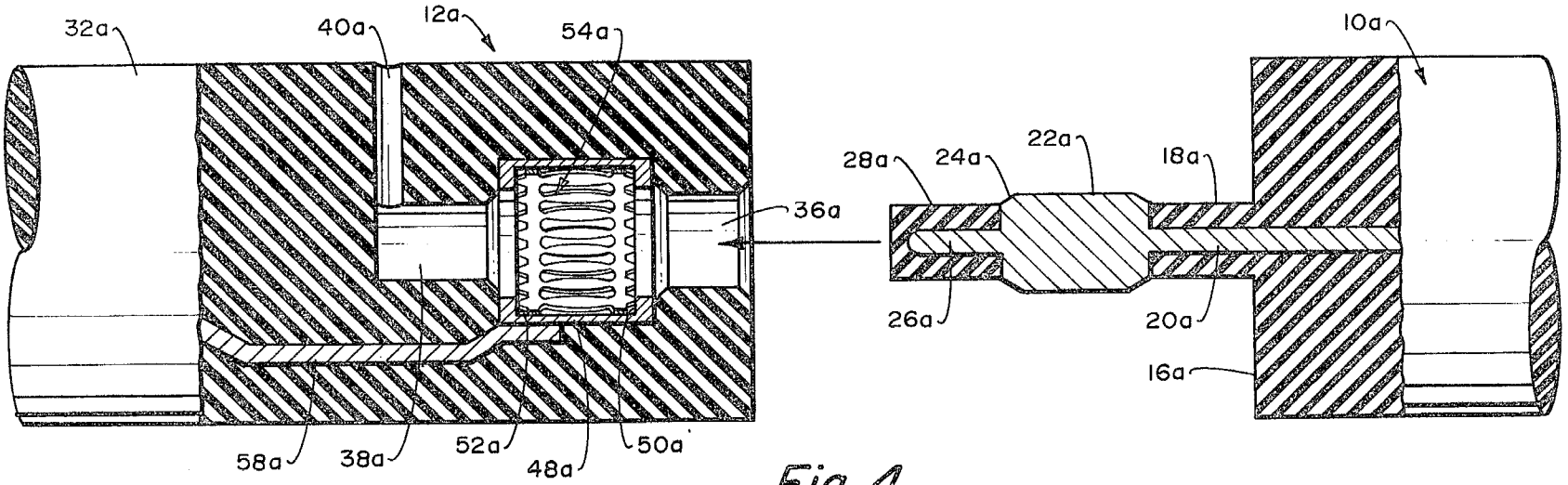
Figure 5:
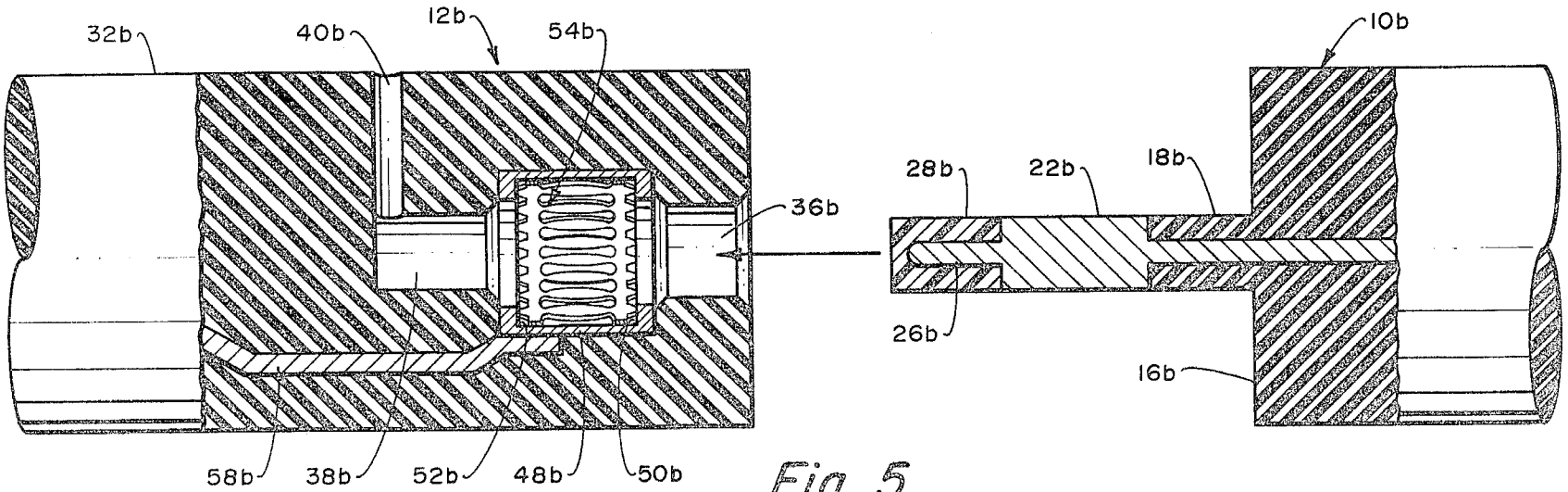

FIGS. *2a*, *2b*, and *2c* illustrate an electrical contact band of the type utilized in the present invention;

FIG. 3 is a longitudinal cross-sectional view of the first embodiment showing the plug body and socket body in connected position;

FIG. 4 is a longitudinal cross-sectional view of a second embodiment showing the plug body and socket body in separated condition; and FIG. 5 is a longitudinal cross-sectional view of a third embodiment showing the plug body and the socket body in separated condition

DESCRIPTION OF THE PREFERRED EMBODIMENT

Figure 1:
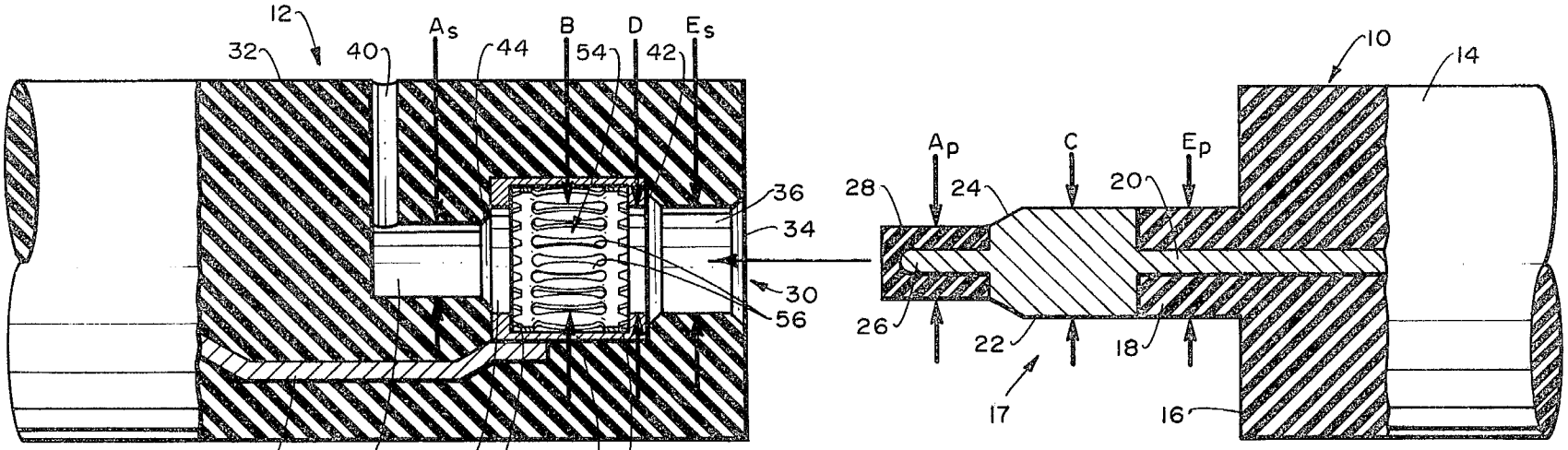
FIG. 1 is a longitudinal cross-sectional view of a first embodiment showing the plug body and socket body in separated condition preparatory to effecting an electrical connection.

Referring now to the drawing and, in particular to FIG. 1, there is shown a view of the mating portions of matched pair of underwater-mateable connectors consisting of a male plug body 10 and a female socket body 12. The plug body 10 includes a molded dielectric elastomer 14 having an annular shoulder 16 from which extends an elongated pin 17. The first portion of the pin 17 is formed by an elongated neck 18 having a diameter Ep and extending from the annular shoulder 16. The neck 18 serves as a trailing seal when the plug body 10 and socket body 12 are mated. A rigid electrical conductor 20, which is coupled at one end to an external conductor (not shown) is embedded in the elastomer 14 and extends longitudinally therein and through the pin 17. The rigid electrical conductor 20 has a contact portion 22 of diameter C which abuts the end of the elongated neck 18. The other end of the contact portion 22 is tapered as shown at 24. The rigid conductor 20 extends beyond the contact portion 22 to form a terminating portion 26. The terminating portion 26 is encapsulated by a molded dielectric elastomer 28 of diameter Ap which forms a leading seal with the socket body 12 when mated. As shown, the peripheral surface of the contact portion 22 of the conductor 20 is exposed while the remainder of the conductor is covered by the insulating elastomers 14 and 28. Further, the diameter C of the electrical contact portion 22 is substantially the same as the diameter, Ep, of the elongated neck 18 and the diameter, Ap, of the molded elastomer 28 is substantially the same as the diameter of the contact portion 22 at the end of tapered section 24.

Referring now to the socket body 12, the socket body includes an elongated socket 30 formed in a molded dielectric elastomer 32 and extendng longitudinally therein. The socket 30 is flared at the entrance 34 to facilitate alignment and insertion of the end of the pin 17 into the socket 30. The socket has three sections with a first section 36 and a third section 38 dimensioned to be complementary to the elongated neck 18 and to the terminating dielectric elastomer 28, respectively, of the pin 17. The diameter, Es, of the first section 36 and the diameter, As, of the third section 38 are slightly smaller than the diameters, Ep and Ap, of the corresponding sections of the pin 17 so that interference seals are formed when the connectors are mated. The socket 30 is vented to the ambient environment by a passage 40 extending from the rear of the third section 38 through the dielectric elastomer 32.

The interior ends of sections 36 and 38 are flared at 42 and 44, respectively, to the intermediate section 46 of the socket 30. A socket contact ring 48 having annular shoulders 50 and 52 is molded within the intermediate section of the socket. Shoulder 52 is tapered to be complementary to the tapered end of contact portion 22. The shoulders 50 and 52 retain a metallic contact band 54 which is integrally provided with a multiplicity of resiliently deformable substantially parallel louvers 56 and which is in electrical contact with the contact ring 48. An electrical conductor 58 is coupled to the contact ring 48 for making an external electrical connection with the contact ring.

The contact band 54 is preferably of the type described in U.S. Pat. No. 3,453,587, by R. Neidecker, incorporated by reference herein, and manufactured by Multilam, Inc., of Los Altos, Calif. A Multilam ® band is illustrated in FIGS. *2a, 2b,* and *2c*. Those skilled in the art will recognize that various designs are suitable for the contact band 54 other than the Multilam ® band; however, the Multilam ® band is preferred, primarily because it provides low insertion force, low electrical resistance and high reliability.

For a given desired current-carrying capacity, the size of the Multilam ® band 54 and hence the diameter and length of the contact ring 48 and the plug contact area 22 are set by the manufacturer's guidelines. The diameter, Ap, of the elastomer 28 at the leading edge of the plug must be less than the inner diameter of the Multilam ® louvers, denoted by diameter B, to prevent the louvers 56 from cutting the elastomer 28 during mating. The plug contact diameter C is nominally a few thousandths of an inch larger than the louvers' inner diameter B. The diameter (identified by D) of shoulder 50 of the contact ring 48 is also a few thousandths of an inch larger than the plug contact diameter C to allow tolerance and clearance for mating.

Underwater mating of the connectors 10 and 12 requires simply aligning the pin 17 and socket 30 (aligning the proper pins in a multiple pin connector system) and pushing the plug body and socket body together. During the first portion of the stroke, minimal force is required because the leading edge of the plug, the dielectric elastomer 28, is smaller than the first section 36 of the socket 30 (diameter Ap is less than diameter Es). As the electrical pin contact 22 enters the first section 36 of the socket 30, a seal is formed by the interference fit of the pin contact 22 in the first section 36 of the socket. As the connectors continue together with a mating force determined by the friction between the contact 22 and the dielectric elastomer 32, water inside the socket 30 is forced out through the vent passage 40 in the rear of the socket. When the front of the plug (elastomer 28) reaches the third section 38 of the socket, a second seal is formed against the matching surface of the third section 38. A chamber is formed between the two seals within the socket. The fluid trapped in this chamber is pressurized as mating continues because of the difference in diameter between the leading seal (diameter A) and the trailing seal (diameter D). A piston is produced with the section of diameter D acting as the head and the section of diameter A acting as the rod. Experience has shown that an internal pressure of this type will easily lift the seals at the ends and allow the small amount of excess water in the chamber to escape as the connectors become mated as shown in FIG. 3. Thus, there is very little resistance to mating from this effect. Since the friction between the elastomer sealing surfaces is small and since the mating force for the Multilam ® contact is also very small compared to other electrical contact systems, the resultant mating force is much less than in previous designs.

After the connectors are mated, there will be a force tending to push the connectors together whenever the ambient pressure increases over that at which the connectors were mated. Similarly if the ambient pressure decreases the fluid inside will tend to expand and force the connectors apart slightly. It will be recognized that these forces can be easily overcome with conventional locking collars of various suitable designs.

While the use of the Multilam ® band 54 does significantly reduce the frictional forces in mating/unmating the connectors, the dissimilar diameter on the seals and the plug contact 22 can produce a hydraulic lock effect as the connectors are unmated whenever the ambient pressure is high. This effect must be minimized by keeping the pin size as small as practical and keeping the clearance close. Another technique found in practice to minimize this effect is to flex the mated connectors from side to side during unmating. The rugged design allows this without damage and the motion helps break the seal and prevent the hydraulic lock.

The arrangement of the rigid smooth male pin contact surface 22 and a rigid female ring 48 housing the Multilam ® louver 54 is capable of maintaining several thousandths of an inch clearance, bridged only by the spring louver electrical contacts 56, even in the presence of compressive loads induced through thermal and ambient pressure cycles found in deep ocean applications. The contact will thus be almost totally depth insensitive and so would be applicable not only to operations involving shallow matings in deep operations but also could involve deep matings (such as by submersibles) as well. The Multilam ® contact provides extremely high localized contact pressures which have been shown to be capable of cutting through surface oxide and contaminant films and thus will provide a superior contact to the previously used split ring system even without the wiping action of the rubber insulation just before mating. This will improve the life of the leading edge of the insulation 28 and allow it to perform its sealing function as intended. The rigid ring 48 supporting the Multilam® louver 54 is much simpler to mold around and will by definition not have any flashing extruding through it. Any edge flashing left will be easier to remove because of the stepped diameters of the insulation surfaces and any still left will not be a problem because Multilam® louver 54 is capable of cutting right through it, or simply deflecting it between the louvers. With the reduced mating force for a single pin, it would become practical to have more pins in a single connector, which is an advantage in packaging for weight and space limited applications.

The length of the dielectric path through the seals 28 and 18 from the conductors to seawater either via the internal vent 40 or at the socket-plug interface determines the maximum operating voltage of the unit. In practice, length of approximately 1 pin diameter is needed for sealing. This also provides the resistance needed to allow operation at up to about 1,000 volts.

Figure 2A:
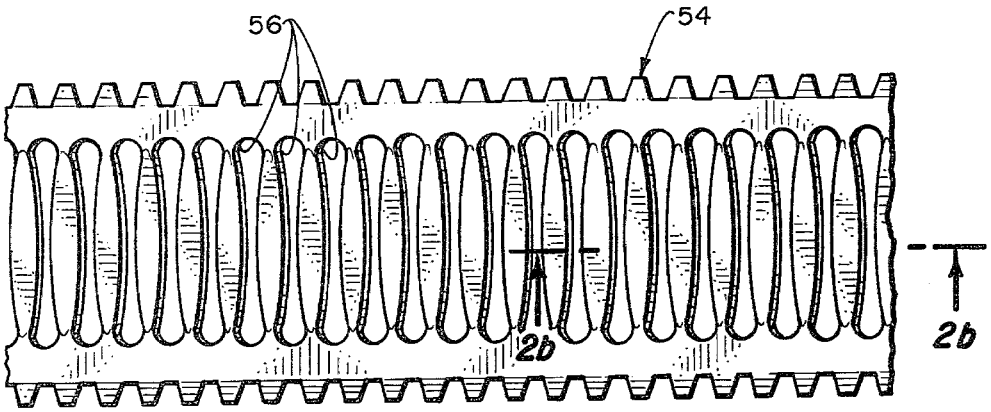
Figure 2B:
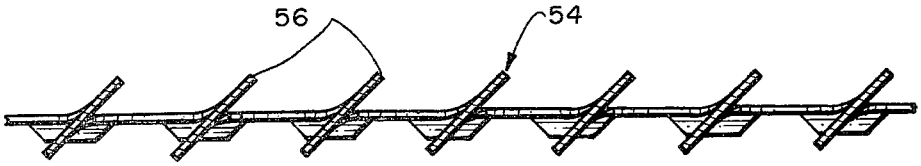
Figure 2C:
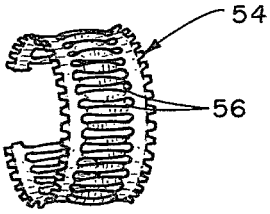

Referring now to FIG. 4, there is shown an alternate embodiment in which the connectors of FIG. 1 are modified so that the trailing seal insulation 18*a* is reduced in diameter to the diameter of the leading insulating seal 28*a*. As shown, both the trailing edge and the leading edge of the contact portion 22*a* are tapered so that the insulating seals 18*a* and 28*a* are slightly smaller in diameter than the contact portion. The shoulder 50*a* of the contact ring of the socket body is also modified to be complementary to the shape of the pin. The fact that the leading seal 28*a* and the trailing seal 18*a* are of the same diameter reduces the pressure differential during much of the mating/unmating operation and eliminates it entirely once the connectors are mated. Therefore, there is no tendency for the connectors to mate/unmate because of ambient pressure changes as is the case in the embodiment of FIGS. 1 and 2. However, the mating force during the first portion of the mating stroke is increased due to the interference fit between the leading seal 28*a* and the first section 36*a* of the socket 30*a*.

FIG. 5 shows a second variation of the underwater mateable connectors in which the leading and trailing seals 28*b* and 18*b* are both the same diameter as the pin contact 22*b* in this embodiment the leading seal 28*b* must be of a rigid insulation material such as plastic to allow the seal to pass through the Multilam® band 54*b* without damage to the insulation. For a given contact diameter C, the connectors of FIG. 5 have a higher mating force than the connectors of the first and second embodiment because of the larger seal areas (i.e., the leading seal 28 is smaller that the contact 22 in FIG. 1, and both the leading seal 28*a* and the trailing seal 18*a* are smaller than the contact 22*a* in FIG. 3).

It should be noted that fluid will be trapped in the contact area between seals when the connectors are mated in each of the embodiments. There will be a differential between the pressure of the fluid in the enclosed contact area and the ambient pressure whenever the mated connectors move from the environment (depth) at which mating occurred. This pressure differential will tend to put pressure on the seals which may cause, in the case of large pressure differentials, the seals to leak slightly until the pressure within the connector contact area is equal to the ambient. This, of course, may result in a short circuit to the external environment. It is therefore noted that the connectors of the present invention may not be suitable for mating at a first pressure for use at a greatly increased or decreased pressure.

The precise selection of pin diameter and clearance is open to variation however, as is the tracking path length. The materials to be used must be suited to the expected fluid environment. The metals must resist corrosion and may be plated or clad if required. Use of surface treating techniques to improve contact wear properties is also an option. With proper selection of dielectric materials and pin diameters it is also possible to construct the connector to provide multiple pins, in various arrangements with suitable keying features and suitable locking collars. In a single-pin connector the Multilam® contact allows the unit to swivel freely if the housing is suitable.

Obviously, many modifications and variations of the present invention are possible in the light of the above teachings. It is therefore to be understood that within the scope of the appended claims the invention may be practiced otherwise than as specifically described.

We claim:

1. An underwater-mateable connector system comprising:

male connector means including an elongated pin, said pin having an electrical conductor disposed therein, said electrical conductor including a contact portion having its surface exposed intermediate the ends of said pin, said pin having dielectric material disposed surrounding said electrical conductor except where said contact portion is exposed and forming the leading surface of said pin in front of said contact portion and the trailing surface of said pin behind said contact portion;

said pin being circular in cross-section and the leading surface of the pin in front of the contact portion being smaller in diameter than the contact portion;

the leading portion of said pin in front of the contact portion being of substantially uniform cross-sectional area and said contact portion having two sections, a first contact section of substantially uniform cross-sectional area and a second contact section which tapers from the cross-sectional area of the first section to the cross-sectional area of the leading portion of said pin;

female connector means including a dielectric socket body containing an elongated socket, said socket having a first socket section at the entrance thereof, a second socket section intermediate the ends thereof and a third socket section at the distal end thereof, said socket body having a vent passage communicating between the distal end of said socket and the external environment, an electrically conducting contact ring disposed in the second socket section of said socket and coupled to an electrical conductor disposed in said socket body, and an electrically conducting contact band integrally provided with a multiplicity of resiliently deformable louvers disposed within said contact ring in the second socket section of said socket and in electrical contact with said contact ring, the first socket section being dimensioned to be complementary to the dimensions of the trailing surface of said pin and the third socket section being dimensioned to be complementary to the dimensions of the leading surface of said pin so that interference seals are formed when said connectors are mated, said contact band and the contact portion of said pin being dimensioned so that the contact portion engages said contact band to provide electrical connection between said male connector means and said female connector means when said connectors are mated.

2. An underwater-mateable connector system as recited in claim 1 wherein said dielectric material surrounding said electrical conductor in said male connector means is a dielectric elastomer.

3. An underwater-mateable connector system as recited in claim 1 wherein the dielectric material forming the leading surface of said pin is a dielectric elastomer.

4. An underwater-mateable connector system as recited in claim 1 wherein a rigid dielectric material forms the leading surface of said pin.

5. An underwater-mateable connector system as recited in claim 1 wherein said socket body is formed from a dielectric elastomer.

6. An underwater-mateable connector as recited in claim 1 wherein the trailing surface of the pin behind the contact portion of said pin is smaller in diameter than the contact portion.

7. An underwater-mateable connector system as recited in claim 6 wherein the leading surface and the trailing surface are of substantially the same diameter.

8. An underwater-mateable connector system as recited in claim 1 wherein the interior ends of the first and the third sections of the socket are flared to the second section of the socket, said second socket section including a cylindrical cavity in which said contact ring is disposed.

9. An underwater-mateable connector system as recited in claim 8 wherein said contact ring has annular shouders for retaining said contact band in the second section of said socket.

10. An underwater-mateable connector system as recited in claims 1 or 8 or 9 wherein said contact band is a Multilam ® band.

* * * * *